US010370966B1

(12) United States Patent
Sollami

(10) Patent No.: US 10,370,966 B1
(45) Date of Patent: Aug. 6, 2019

(54) REAR OF BASE BLOCK

(71) Applicant: Phillip Sollami, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

(21) Appl. No.: 14/690,679

(22) Filed: Apr. 20, 2015

Related U.S. Application Data

(60) Provisional application No. 61/983,291, filed on Apr. 23, 2014.

(51) Int. Cl.
*E21C 35/19* (2006.01)
*E21C 35/18* (2006.01)

(52) U.S. Cl.
CPC ..... *E21C 35/18* (2013.01); *E21C 35/19* (2013.01); *E21C 2035/1826* (2013.01); *E21C 2035/191* (2013.01)

(58) Field of Classification Search
CPC ..... E21C 2035/191; E21C 2035/1826; E21C 35/19
See application file for complete search history.

(56) References Cited

U.S. PATENT DOCUMENTS 4,525,178 A 6/1985 Hall
4,570,726 A 2/1986 Hall
4,604,106 A 8/1986 Hall
4,694,918 A 9/1987 Hall
5,374,111 A 12/1994 Den Besten
5,415,462 A 5/1995 Massa
5,417,475 A 5/1995 Graham et al.
6,371,567 B1 4/2002 Sollami
6,584,810 B2 7/2003 Montgomery
6,685,273 B1 * 2/2004 Sollami ..... B28D 1/188 299/102
6,733,087 B2 5/2004 Hall
6,866,343 B2 * 3/2005 Holl ..... E21C 35/193 299/102
D554,162 S 10/2007 Hall
7,320,505 B1 1/2008 Hall
7,338,135 B1 3/2008 Hall
7,347,292 B1 3/2008 Hall
(Continued)

FOREIGN PATENT DOCUMENTS

DE 102011079115 1/2013
DE 102015121953 7/2016
DE 102016118658 3/2017

*Primary Examiner* — Janine M Kreck
*Assistant Examiner* — Michael A Goodwin
(74) *Attorney, Agent, or Firm* — Mercedes V. O'Connor; Rockman Videbeck & O'Connor

(57) ABSTRACT

An improved base block is disclosed for use mainly in road milling equipment, but also capable of use in trenching equipment and mining equipment. The base mounting portion is shortened in length from such prior art base blocks and has a reduced length device receiving portion extending therefrom that includes a bore therethrough. Rearwardly of the device receiving portion, the base mounting portion includes a reduced diameter semi-bore or curved wall capable of engaging a portion of the shank side wall of a standard length bit/holder shank. Additionally, an angled slot adjacent the rear of the device receiving bore increases access to the rear to aid removal of a bit/holder therefrom.

22 Claims, 6 Drawing Sheets

(56) References Cited

U.S. PATENT DOCUMENTS

D566,137 S 4/2008 Hall
7,353,893 B1 4/2008 Hall
7,384,105 B2 6/2008 Hall
7,396,086 B1 6/2008 Hall
7,401,862 B2 * 7/2008 Holl ..... B28D 1/188 299/106
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
D581,952 S 12/2008 Hall
7,464,993 B2 12/2008 Hall
7,469,756 B2 12/2008 Hall
7,469,972 B2 12/2008 Hall
7,475,948 B2 1/2009 Hall
7,523,794 B2 4/2009 Hall
7,569,249 B2 8/2009 Hall
7,569,971 B2 8/2009 Andle et al.
7,571,782 B2 8/2009 Hall
7,575,425 B2 8/2009 Hall
7,588,102 B2 9/2009 Hall
7,594,703 B2 9/2009 Hall
7,600,823 B2 10/2009 Hall
7,628,233 B1 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,832,808 B2 11/2010 Hall
7,883,155 B2 2/2011 Sollami
7,963,617 B2 6/2011 Hall
7,992,944 B2 8/2011 Hall
7,992,945 B2 8/2011 Hall
8,007,051 B2 8/2011 Hall
8,033,615 B2 10/2011 Hall
8,038,223 B2 10/2011 Hall
8,061,784 B2 11/2011 Hall
8,109,349 B2 2/2012 Hall
8,136,887 B2 3/2012 Hall
8,215,420 B2 7/2012 Hall
8,292,372 B2 10/2012 Hall
2004/0004389 A1 1/2004 Latham
2006/0071538 A1 4/2006 Sollami
2009/0261646 A1 10/2009 Ritchie
2010/0253130 A1 10/2010 Sollami
2011/0006588 A1 1/2011 Monyak et al.
2011/0254350 A1 10/2011 Hall
2012/0027514 A1 2/2012 Hall
2012/0038203 A1 2/2012 Hall
2012/0068527 A1 * 3/2012 Erdmann ..... B28D 1/188 299/106
2012/0181845 A1 * 7/2012 Sollami ..... B25B 23/0035 299/108
2012/0248663 A1 10/2012 Hall
2012/0261977 A1 10/2012 Hall
2012/0280559 A1 * 11/2012 Watson ..... E21C 35/18 299/106
2013/0307316 A1 * 11/2013 Roetsch ..... B28D 1/188 299/39.4
2015/0240634 A1 8/2015 Sollami
2015/0300166 A1 * 10/2015 Ries ..... E21C 35/1933 299/105
2016/0194956 A1 7/2016 Sollami
2017/0089198 A1 3/2017 Sollami

* cited by examiner

REAR OF BASE BLOCK

This invention claims priority of provisional application Ser. No. 61/983,291 filed Apr. 23, 2014, the contents of which are incorporated herein by reference.

This invention relates to base blocks mainly for use in road milling machinery, but also capable of being used in mining and trenching equipment.

BACKGROUND OF THE INVENTION

Road milling bits and bit holders, the design of which, when made in differing sizes, can also be used for trenching machines and mining machines, have benefited greatly from what has been termed a "quick change tooling system," found in the instant inventor's prior U.S. Pat. Nos. 6,371,567; 6,685,273; and 7,883,155.

In applicant's recently filed, provisional patent application, Ser. No. 61/944,676, filed Feb. 26, 2014, now application Ser. No. 14/628,482 filed Feb. 23, 2015, applicant discloses the findings that most of the retaining force between the diametrically compressed slotted portion of the shank in a quick change system and the base block bore is radially located near the top of the slotted portion of the shank. Indeed, the further one gets from the top of the slot, the less the distal end of the approximately 2½ inch long shank applies force to the base block bore.

In applicant's copending application, identified above, applicant has shortened the shank from a full length of approximately 2⅜ inches to about 1½ inches in length and has obtained about the same retention force between the bit/holder shank and the base block bore, between about 5,000 and 30,000 pounds of radial force.

A need has developed for providing additional access to the rear of a base block for removing a bit, a bit holder or a combination bit/holder.

SUMMARY OF THE INVENTION

The invention resides in a shorter or less lengthy base block with a corresponding shorter base block bore, when combined with the about 1½ inch length bit holder shank, provides for additional space at the rear of the base block for additional tool access.

BRIEF DESCRIPTION OF THE DRAWINGS

The features of the present invention which are believed to be novel are set forth with particularity in the appended claims. The invention may best be understood from the following detailed description of currently preferred embodiments thereof taken in conjunction with the accompanying drawings wherein like numerals refer to like parts, and in which:

DETAILED DESCRIPTION OF THE PREFERRED EMBODIMENTS

Figure 2:
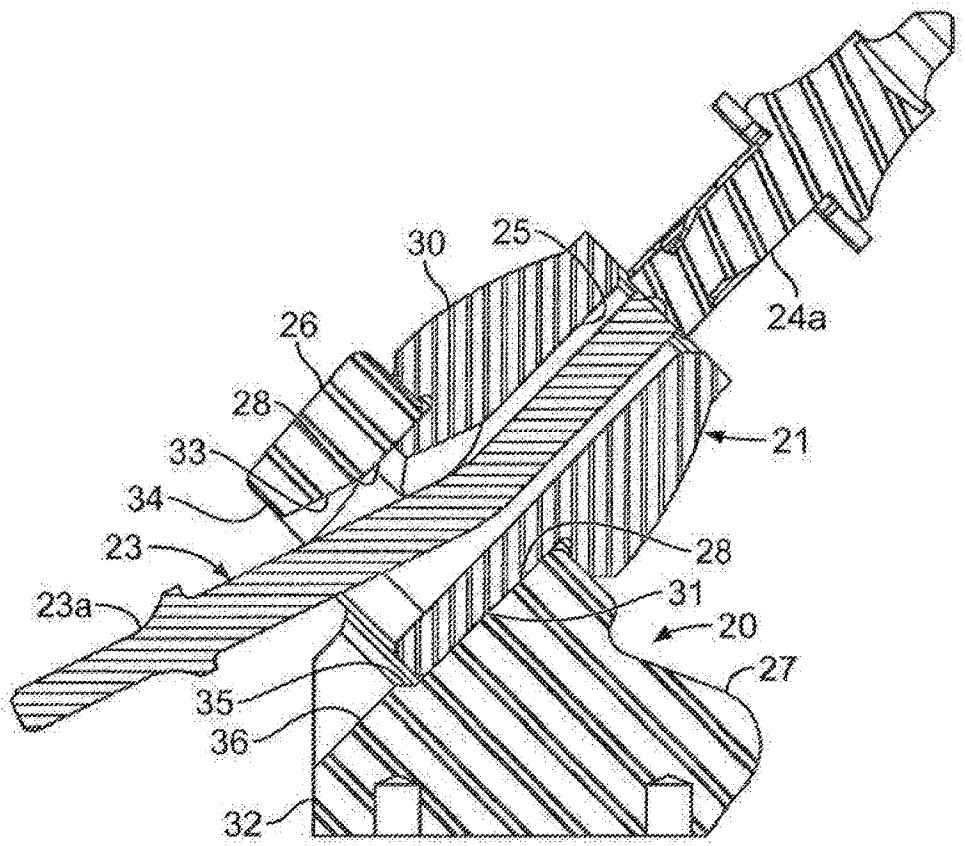
FIG. 2 is a cross sectional view taken along line 2-2 of FIG. 1.
Figure 1:
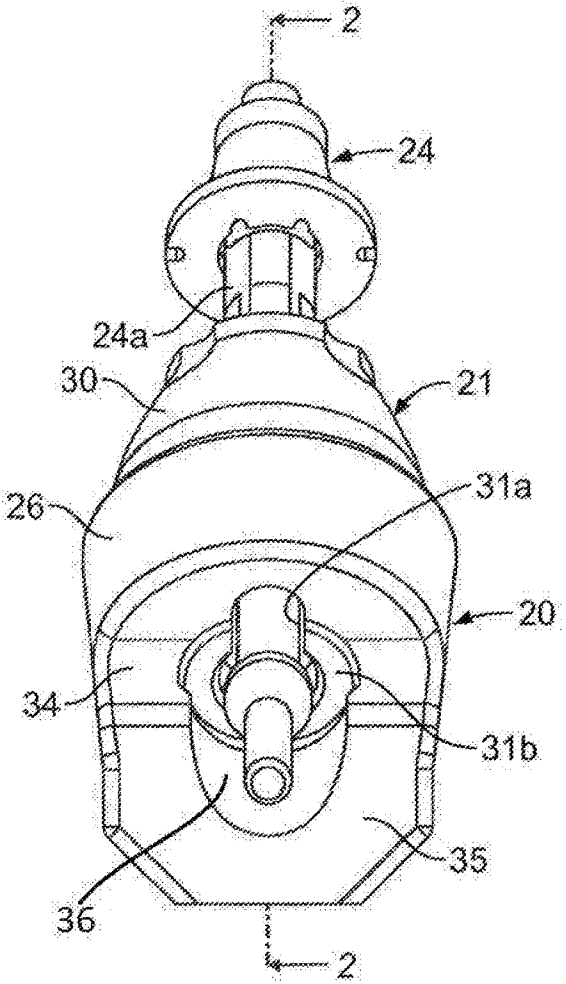
FIG. 1 is an end elevational view of a bit assembly, constructed in accordance with the present invention, with the addition of a bit removal tool shown forcing a bit out of its bit holder.
Figure 3:
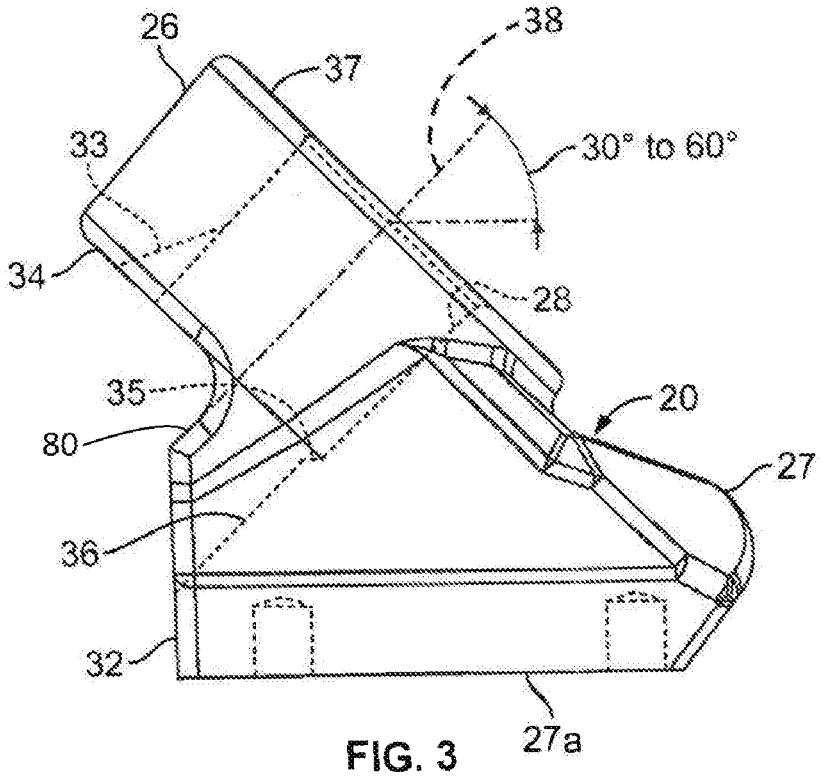
FIG. 3 is a side elevational view of the first embodiment of the bit block shown in FIG. 1.

Referring to FIGS. 1, 2 and 3, a first embodiment of a base block 20, constructed in accordance with the present invention, is shown together with a first embodiment of a bit holder 21 mounted therein in FIGS. 1 and 2, and also showing an angled drift pin 23 pushing out a bit 24 from the central bore 25 of the bit holder 21.

The base block 20 shown in FIGS. 1, 2 and 3 is a modification of the base block shown in Applicant's recently filed and provisional application Ser. No. 61/944,676 filed Feb. 26, 2014, now Ser. No. 14/628,482 filed Feb. 23, 2015, the contents and drawings of which are incorporated herein by reference.

As in the '482 application, the base block 20 of FIGS. 1, 2 and 3 includes a shortened front end 26 and a base 27 including a base surface 27*a* (FIG. 3) which may be flat or slightly concave to fit a drum or additional mounting plates thereon (not shown) on which a plurality of base blocks may be mounted, usually in chevron or spiral fashion. Outwardly of the mounting portion or base of the base block 20, is a generally annular bit holder mounting portion, also called a device receiving portion, or front end 26, having a central nominal 1½ inch diameter annular or generally cylindrical bore 28 positioned therethrough which is generally positioned at between 30 to 60 degrees from the horizontal. The annular device receiving or bit holding portion 26 of the base block is, in this embodiment, about 1½ inches in length or greater and is configured to receive a bit holder or a device.

As in the previous embodiment, the base block bore 28 has been shortened from about 2⅜ inches in length to 1½ inches in length preferably by removing material from the back of the mounting portion, and thus providing added space behind the device receiving or holder mounting portion 26 of the base block 20. This added space from prior art base blocks provides additional access up to about ⅞ inch from the mounting portion for tools to remove or punch out either bits 24 from a bit holder annular or circular bore 25, or a bit holder 21 from the base block bore 28. FIGS. 1 and 2 show a bit 24 or broken shank with its generally cylindrical shank 24*a* being pushed out of a bit holder bore 25 by a bent drift pin 23 which is configured on its base end 23*a* to fit into a pneumatically operated tool (not shown).

The bit holder 21 shown in FIG. 2 has an upper body portion 30, and a lower shank portion 31 which is slotted at 31*a* to allow the shank 31 to compress radially when inserted in the base block bore 28. The force between the diametrically contracted slotted shank 31 and the base block bore 28 maintains and retains the bit holder 21 in the bit block 20. In the instant application, the bit block annular portion 26 has been shortened from approximately 2⅜ inches in length, which is the bit holder shank length utilized in applicant's U.S. Pat. Nos. 6,371,567; 6,685,273; and 7,883,155, the contents and drawings of which are incorporated herein by reference.

As indicated in the preceding application noted above, Applicant has discovered that the bulk of the forces between the slotted shank 31 of the bit holder 21 and the base block bore 28 occur adjacent the top of the slot 31*a* in the shank 31. Indeed, in the copending application, Applicant has disclosed a shank that is configured at a more outwardly extending angle than the angle of the base block bore. That is, if the shank 31 is a straight cylindrical member, the bit block bore 28 will be slightly tapered inwardly, or tapered to the centerline of the holder.

By adjusting the relative angles between the outer surface of the shank 31 and the base block bore 28, the position of the forces between those two structures may be engineered to occur where most beneficial along the axis of the shank 31.

Returning to the base block 20, the base block of the present invention has several distinct differences from the base block shown in the copending patent application. First, the bottom end 34 of the base block bore 28, in this embodiment, includes a semi cylindrical angular slot 33, preferably at the radially outermost portion of the base block bore. This angular slot 33 allows added room for the drift pin 23 shown in FIG. 2 to operate. Additionally, in the cutaway portion of the bottom or rear end 34 of the annular bit holder shank holding or receiving portion 26 of the base block 20, adjacent the mounting portion 27 of the base block, a transitional reduced radius angular wall or discontinuity 35 is formed on the bore relative to the bore axis or centerline 38 such that a segmental radius leads to a slightly smaller radius extension or cutaway portion 36. The extension of the arcuate segment 36 extends onto a surface 80 (FIGS. 3, 4, 10, and 11) of the base block 20. The surface 80 extends to a first plane including the central axis 38 of the bore and/or a second plane below the first plane. This reduced radius extension of an arcuate segment of said bore 36, which may be ⅞ inch in length does not serve a function when the base block and shorter shank bit holder are used. But its function will be disclosed in more detail below.

As mentioned in connection with FIG. 3, the bore 28 through the bit holder holding portion of the base block 20 may be cylindrical, or slightly inwardly tapered or slightly outwardly tapered as long as the shank 31 of the bit holder extends outwardly more at its distal end 31*b* than that of the bit holder block bore 28. As noted previously, if it is desirable to have more radial interference between the bit holder shank 31 and the base block bore 28 adjacent the top 37 of the base block bore 28, this shank portion may be increased in diameter relative to that of the base block holder bore.

FIG. 3 discloses a base block bore 28 that is either a continuous cylindrical or an inwardly tapered angle continuously along its length from the top 37 of the bit holder mounting portion to the bottom 34 of the bit holder shank mounting portion 26. This bore 28 is generally positioned at a 30 to 60 degree angle to the bottom surface 27*a* of the base block 20. The semicircular angled slot 33, also shown in FIG. 1, is shown in dotted line adjacent the outermost portion of the base block bore 28 for allowing increased access of a drift pin removal tool 23 to the back of the base block 20. The reduced diameter 36, as shown most clearly in FIG. 1, starting at the inner portion of the base block bore 28 subjacent the outer back wall 34 of the bit holder shank retaining portion is shown in dotted line 36 as it extends up to about ⅞ inch from that back wall 34 to the rear 32 of the base block mounting portion 27.

Figure 4:
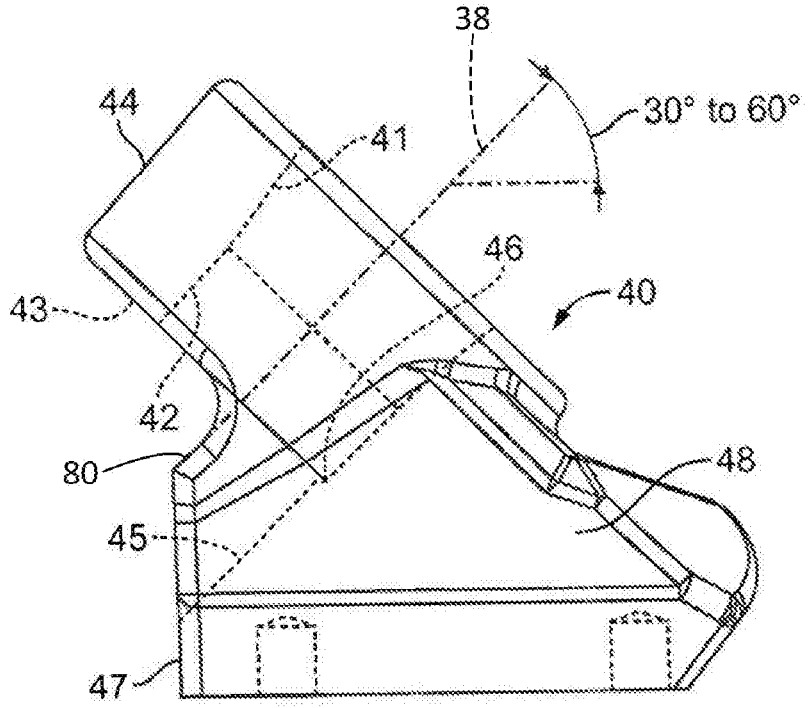
FIG. 4 is a side elevational view of a first modification of the base block shown in FIG. 1.

FIG. 4 discloses a first modification 40 of the base block shown in FIG. 3 wherein the bit block bore includes an upper section 41 that is tapered adjacent the top of the bit holder retaining portion 44, forming an acute angle to the centerline 38 of the bit block bore in this illustrated embodiment, approximately half way through the bit block bore wherein the remainder or lower section 42 of the bit block bore is generally cylindrical in shape to the back wall 43 of the bit holder retaining portion 44. Again, a slight transverse reduced diameter 45 is shown that extends from the ridge 46 at the back of the bit holder block bore 42 to the rearmost portion 47 of the mounting portion 48 of the base block 40.

Figure 5:
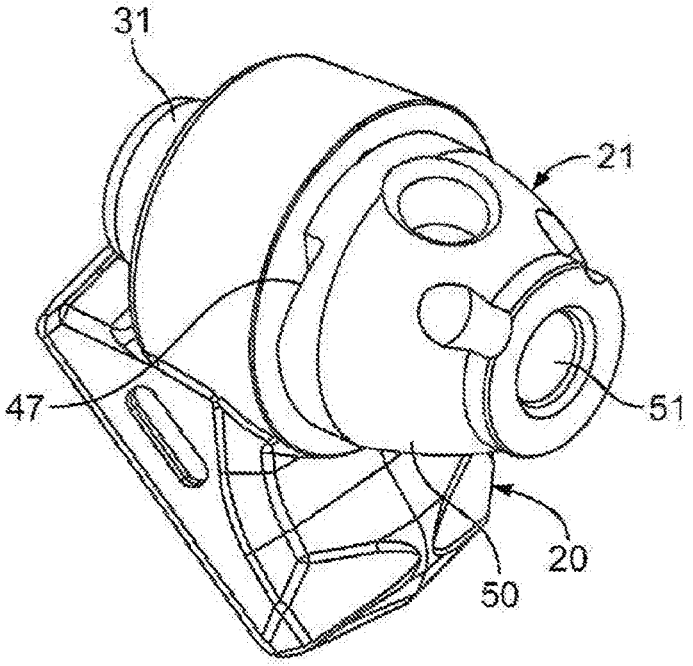
FIG. 5 is a ¾ front perspective view of the base block shown in FIG. 1 with a long shank bit holder mounted therein.
Figure 6:
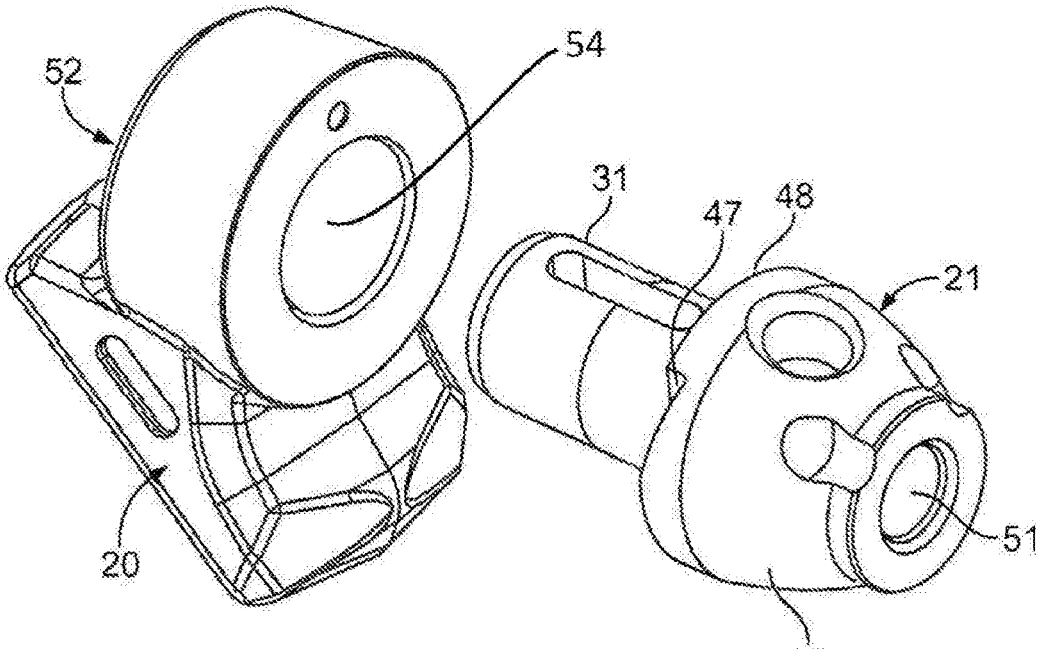
FIG. 6 is a ¾ front exploded view of the long shank bit holder shown in FIG. 5 extended outwardly of the base block shown in FIG. 5.

Referring to FIGS. 5 and 6, the base block 20 of the present invention is shown with a standard 2⅜ inch length bit holder 21 mounted therein instead of the 1½ inch shank length bit holder. A pair of wedge shape notches 47 (one shown) in the back annular face 48 (FIG. 8) of the body portion 50 of the bit holder body extend transversely near the axis of the shank a distance about ⅛ inch shy of the position of a plane perpendicular to the axis of the bore 51.

The configuration shown in FIGS. 5-11 of the instant application discloses the use of the shortened bit holding portion 52 which includes annular bore 54 through the present base block 20 in combination with a standard length shank bit holder 21 as shown in applicant's prior patents.

When applicant's invention is utilized for road milling, mining or trenching operations, the use to which the assembly is subjected is extreme in nature. The industry has worked diligently through the years to increase the useful life of bits, combination bit/holders, and base blocks while performing the extremely tough cutting conditions to which they are subjected. Applicant's present invention utilizing the shortened base block bit holder mounting portion and the shortened bit holder shank on the bit/holder provides substantial benefits over the prior art. However, eventually, these extreme forces will account for wear in the base block bore and wear on the bit holder shank such that a standard short shank bit holder may not successfully be retained in the base block bore.

When such is the case, even after the added cycle of life provided by the instant invention, applicant's present invention provides for utilizing a standard 2⅜ inch length bit holder shank 31 in the improved base block to provide additional use of the base block than heretofore known.

Figure 8:
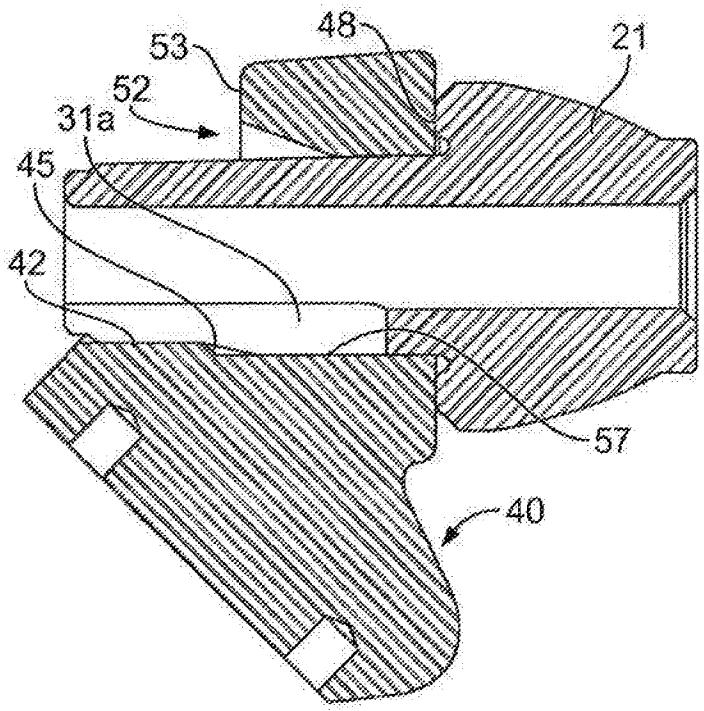
FIG. 8 is a cross sectional view of the bit holder and base block of the current invention with a long standard 2⅜ inch shank inserted in the bit block.
Figure 7:
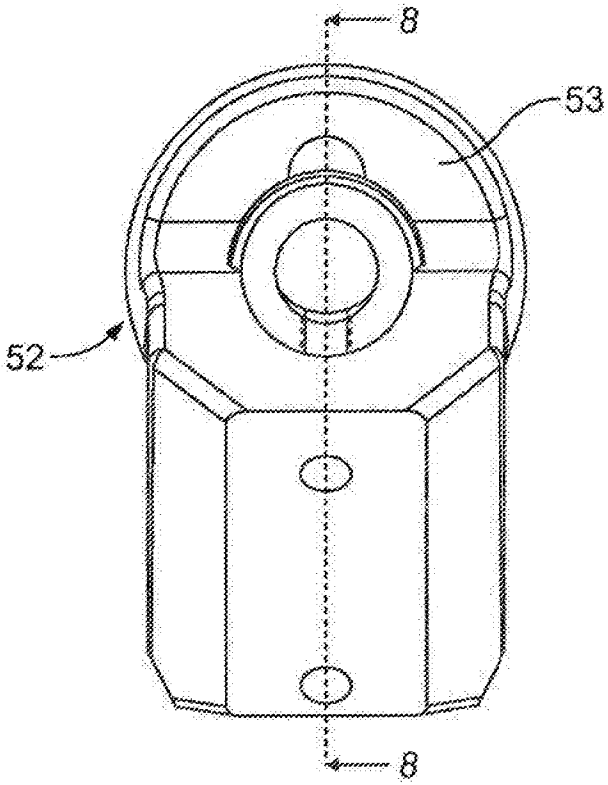
FIG. 7 is an end elevational view of the base block of the present invention.

FIGS. 7 and 8 show the use of the standard 2⅜ inch length shank bit holder 21 as mounted in the base block 40 of the first modification of the present invention. As shown most clearly in FIG. 8, the added reduced diameter interference portion 42 at the rearmost portion of the bit block bore 46 beyond the end or back wall 53 of the bit holder shank retaining portion engages the 2⅜ inch long shank 31 of the bit holder 20 adjacent its distal end and provides sufficient sideways force against that portion of the shank 31 to retain same in the base block 40. The ridge shown in FIG. 8 has been enhanced in size to show its effect in use. Such a ridge 45 and smaller segment portion 42 would be expected to be less than about 0.050 inch in interference.

In the example shown in FIG. 8, the slotted portion of the bit holder shank 31*a* is positioned adjacent the curved reduced diameter wall 42 and ridge 45 to provide the amount of elastic bend to that portion of the shank 31 to retain the shank in the base block bore 51.

Figure 10:
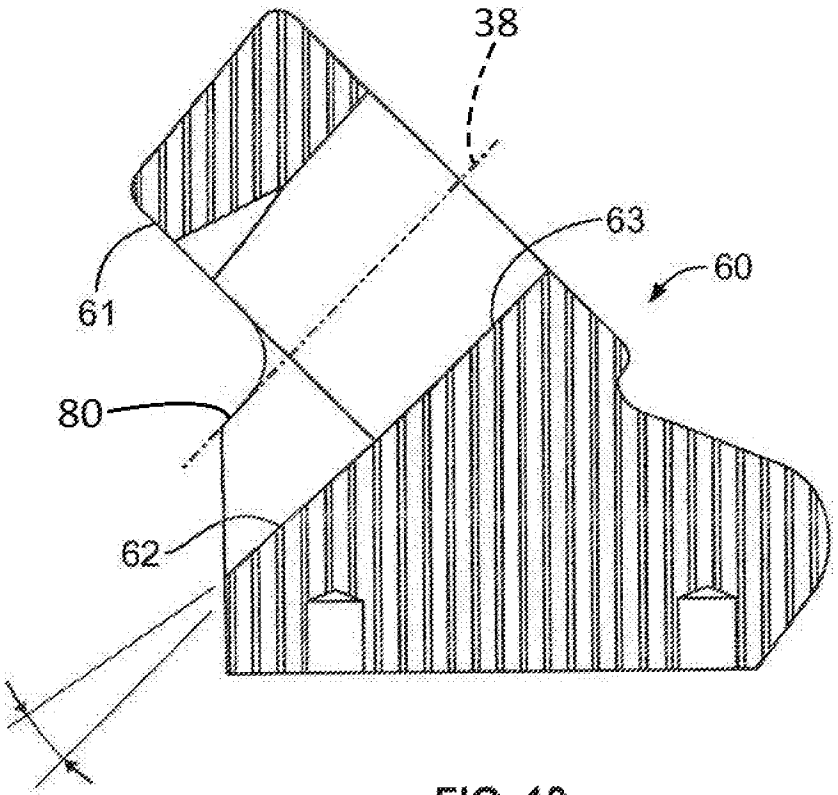
FIG. 10 is a cross sectional view taken along line 10-10 of FIG. 9 wherein the portion of the bit block bore extending from the back of the bit holder retaining portion is slightly tapered at an angle relative to the annular bore to retain a long shank bit holder therein.
Figure 9:
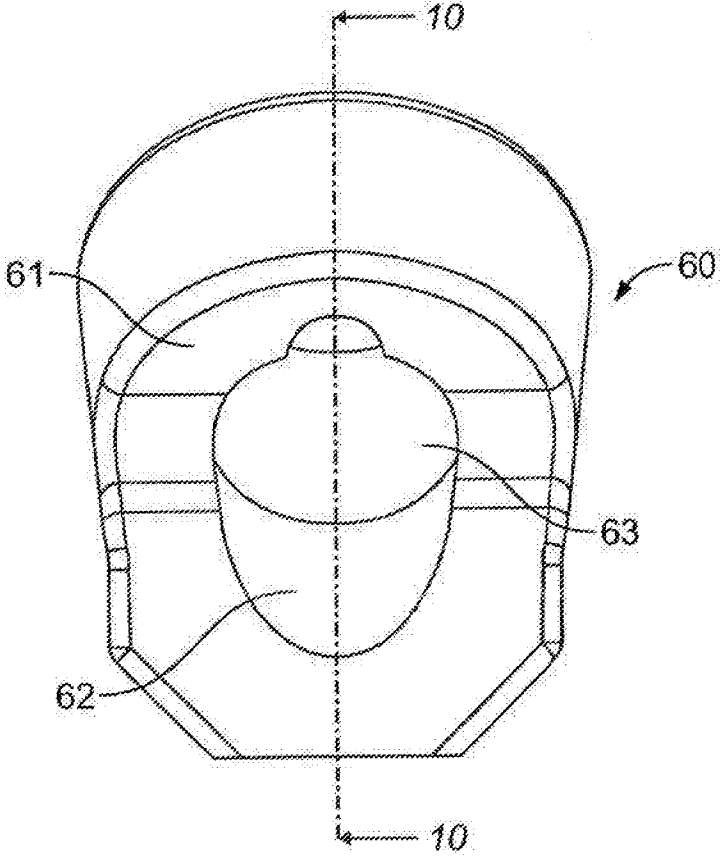
FIG. 9 is an end elevational view of a modification of the base block shown in FIG. 7.
Figure 12:
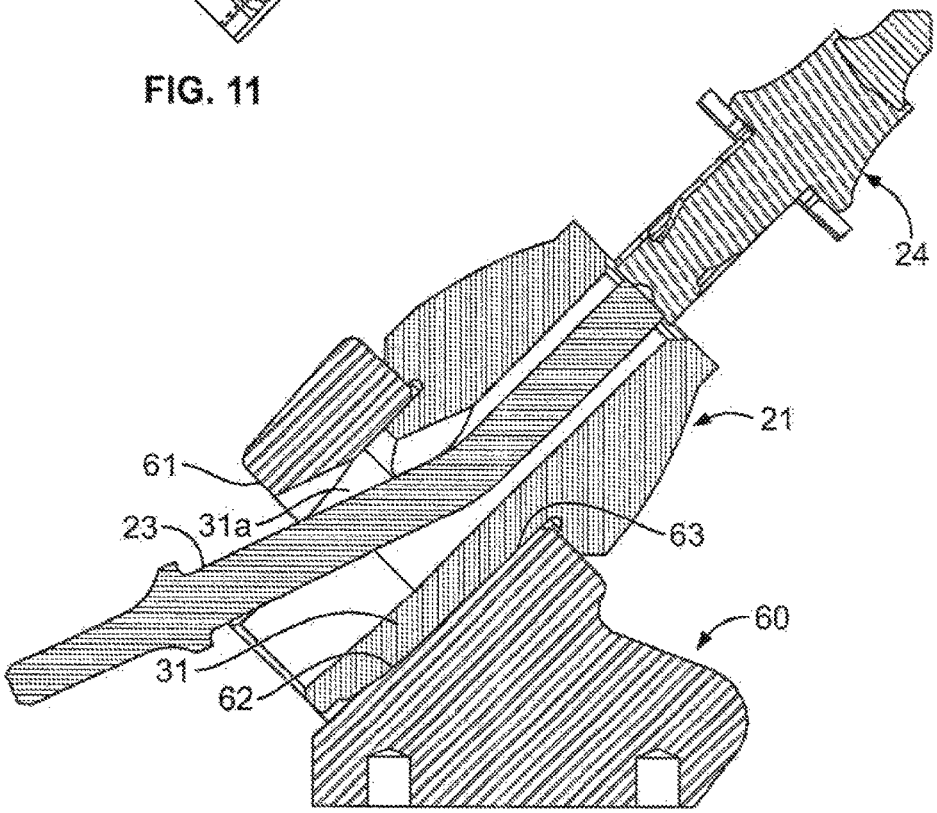
FIG. 12 is a cross sectional view similar to FIG. 10 showing a bit holder mounted in the base block and a drive punch driving out a bit therefrom.

Referring to FIGS. 9, 10 and 12, a second modification of the base block 60 is shown that, while being similar to the first embodiment and first modification thereof does not have a predominant differential diameter ridge adjacent the rear wall of the bit holder shank retaining portion 61 of the base block 60, but has a gradual inwardly tapering or smoothly transitional surface 62 instead which provides a smaller diameter than the radial distance to the axis at the rear of the bit holder block bore 63.

This smaller radius rearmost portion 62 is most useful as shown in FIG. 12, when the solid or internal slotted portion 31*a* of the standard length shank bit holder 21 is mounted in the base block 60 of the second modification of the present invention. The slotted portion 31*a* in a single slotted shank holder 21 can be positioned opposite the smaller semicircular reduced diameter angled segment 62 similar to that bit holder shank position shown in FIG. 8. A lesser interference fit in such case may be required. A slight increasing resistance will be obtained when inserting the standard length bit holder shank 31 in the bit block bore 63 than in the first modification shown in FIG. 8.

Figure 11:
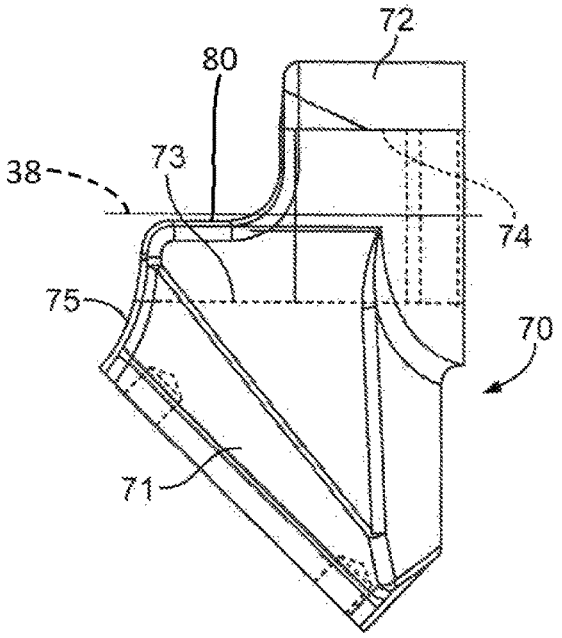
FIG. 11 is a side elevational view of a modification of the base block shown in FIG. 10 where the annular bore and the rear arcuate extension of same are of the same angular configuration.

Referring to FIG. 11, a third modification 70, of the base block of the invention is similar to the first and second base block modifications 40 and 60, respectively. The base or drum mounting portion 71 of the base block mounts the block on a drum (not shown) identically to the previous embodiment and modifications. The outside of the annular bit holding portion 72 is also identical to the previously disclosed embodiment and modifications. The change to the third modification is the continuous angular orientation of the backside arcuate wall 73 extending from the rear of the annular base block bore 74 to the back end 75 of the drum mounting portion. Arcuate wall 73 is formed at the same angle as that of annular bore 74, i.e., from a non-locking taper of 1-3 degrees per side to a straight cylindrical bore.

FIG. 12 shows a construction that is similar to the first embodiment of the invention shown in FIG. 2 in that a bent drift pin 23 may be utilized at the rear of the second modification of the base block 60 to drive a bit 24 from the bit holder 21. It should be noted that the embodiments and modifications shown in the present invention can be utilized with a combined bit/holder shown in applicant's patent application Ser. No. 61/879,353, filed Sep. 18, 2013 now application Ser. No. 14/487,493 filed Sep. 15, 2014, wherein the bit/holder does not have a separate bit mountable on the front end of the bit holder but utilizes a diamond tipped insert mounted in a unitary construction bit/holder. Arcuate surface 62 (FIG. 12) and arcuate surface 73 (FIG. 11) will aid the remainder of the base block bore in retaining a standard length shank as long as the interference between the two is at least 0.005 inch on the diameter and preferably more. The arcuate surface may have a radius greater, equal to or less than the bore as long as there is at least the minimum interference therebetween.

While one embodiment and three modifications of the present invention have been shown herein, it will be understood by those skilled in the art that many changes and modifications may be made without departing from the true spirit and scope of the present invention. It is the intent of the appended claims to cover all such changes and modifications which fall within the true spirit and scope of the invention.

What is claimed:

1. A base block comprising:

a base mounting portion including a base surface;

a device receiving portion integrally extending from said base mounting portion opposite said base surface;

a bore extending through said device receiving portion, said bore oriented at an acute angle to said base surface; and a semi-circular angled slot extending inwardly from a rear of said device receiving portion, the slot enclosed within an outer side wall of the device receiving portion and the bore, the slot decreasing in size from said rear of said device receiving portion to a position mediate a front of said device receiving portion and said rear of said device receiving portion.

2. The base block as defined in claim 1, wherein said slot is positioned contiguous with said bore substantially 180 degrees across said bore from said mounting portion.

3. A base block comprising:

a base mounting portion including a base surface;

a device receiving portion integrally extending from said base mounting portion opposite said base surface;

a generally cylindrical throughbore extending through said device receiving portion, said throughbore oriented at an acute angle to said base surface; and an extension of an arcuate segment of said throughbore, said extension being contiguous with said throughbore, the extension extending past a rear of said device receiving portion and onto a surface of said base mounting portion, the surface of said base mounting portion axially extending from the rear of said device receiving portion, and the surface extending to at least one of a first plane including a central axis of said throughbore and a second plane below the first plane.

4. The base block as defined in claim 3, wherein said extension of the arcuate segment of said throughbore has a radius less than that of said throughbore.

5. The base block as defined in claim 3 wherein said extension of the arcuate segment of said throughbore defines an arcuate surface smoothly transitioning to said throughbore.

6. The base block as defined in claim 3, wherein a top of said extension of an arcuate segment of said throughbore, adjacent the rear of the device receiving portion, defines an arcuate surface smoothly transitioning to said annular throughbore.

7. The base block as defined in claim 3, wherein said extension of the arcuate segment of said throughbore has a radius equal to that of said throughbore.

8. The base block as defined in claim 3, wherein said extension of an arcuate segment of said throughbore has a radius one of less than and equal to that of said throughbore.

9. The base block as defined in claim 3, wherein said generally cylindrical throughbore in said device receiving portion is less than 2⅜ inches in length.

10. The base block as defined in claim 3, wherein the device receiving portion and the extension of the arcuate segment of the throughbore have a combined length equivalent to a full length bit holder shank of approximately 2⅜ inches.

11. The base block as defined in claim 3, wherein the extension is semicircular.

12. The base block as defined in claim 3, wherein the generally cylindrical throughbore is adjacent an angular portion, formed relative to the axis of the throughbore, that transitions from the throughbore to the extension of the arcuate segment.

13. A base block comprising:

a base mounting portion including a base surface;

a device receiving portion integrally extending from said base mounting portion opposite said base surface;

a generally cylindrical throughbore extending through said device receiving portion, said throughbore oriented at an acute angle to said base surface;

an extension of an arcuate segment of said throughbore, said extension being contiguous with said throughbore extending past a rear of said device receiving portion and onto said base mounting portion; and wherein the generally cylindrical throughbore of the device receiving portion includes an angular slot extending inwardly from a rear of the device receiving portion, the angular slot enclosed within a side wall of the device receiving portion and decreasing in size from the rear of the device receiving portion to a position mediate a front portion of the device receiving portion and the rear of the device receiving portion.

14. A base block capable of retaining a generally cylindrical shank of a device therein, said base block comprising:

a base mounting portion including a base surface;

a device receiving portion integrally extending from said base mounting portion opposite said base surface;

a generally cylindrical throughbore extending through said device receiving portion, said throughbore oriented at an acute angle to said base surface; and a surface of said base mounting portion comprising an extension of an arcuate segment of said throughbore, said extension extending past a rear of said device receiving portion, the surface of said base mounting portion axially extending from the rear of said device receiving portion, the surface extending to at least one of a first plane including a central axis of said throughbore and a second plane below the first plane, and said extension of the arcuate segment of said throughbore providing an interference fit with the shank of said device capable of being securely mounted through said generally cylindrical throughbore and having said shank extending outwardly of a rear of said device receiving portion.

15. The base block as defined in claim 14, wherein said interference fit is at least partly provided by a continuous angular orientation of said extension.

16. The base block as defined in claim 14, wherein said extension of the arcuate segment of said throughbore provides an interference fit of at least 0.005 inch diametrically with the shank of said device mounted in said throughbore.

17. The base block as defined in claim 14, wherein said generally cylindrical throughbore has an axial length of about 1½ inches and a nominal diameter of 1½ inches.

18. The base block as defined in claim 14, wherein a total throughbore length plus extension length is greater than 1½ inches.

19. The base block as defined in claim 14, wherein said generally cylindrical throughbore of said device receiving portion of said base block has the same orientation to a centerline of said throughbore from a first position adjacent a top surface of said device receiving portion to a second position adjacent a bottom thereof.

20. The base block of claim 14, wherein the generally cylindrical throughbore is adjacent an angular portion, formed relative to the axis of the throughbore, that transitions from the throughbore to the extension of the arcuate segment.

21. A base block capable of retaining a generally cylindrical shank of a device therein, said base block comprising:

a base mounting portion including a base surface;

a device receiving portion integrally extending from said base mounting portion opposite said base surface;

a generally cylindrical throughbore extending through said device receiving portion, said throughbore oriented at an acute angle to said base surface;

said base mounting portion comprising an extension of an arcuate segment of said throughbore, said extension extending past a rear of said device receiving portion of said base mounting portion, and said extension of the arcuate segment of said throughbore providing an interference fit with the shank of said device capable of being securely mounted through said generally cylindrical throughbore and having said shank extending outwardly of a rear of said base mounting portion; and wherein said generally cylindrical throughbore of said device receiving portion of said base block includes an upper section with a side wall oriented at a greater acute angle to a centerline of said throughbore than an adjacent lower section of said generally cylindrical throughbore.

22. A base block comprising:

a base mounting portion including a base surface;

a device receiving portion integrally extending from said base mounting portion opposite said base surface of said base mounting portion;

a generally cylindrical throughbore extending through said device receiving portion, said throughbore oriented at an acute angle to said base surface; and an extension of an arcuate segment of said throughbore, said extension being continuous with said throughbore extending past a rear of said device receiving portion and onto said base mounting portion, and said extension oriented at the acute angle to the base surface.

* * * * *